United States Patent [19]

Steele

[11] 4,289,008

[45] Sep. 15, 1981

[54] APPARATUS FOR FORMING A UNIVERSAL CHASE TOP

[75] Inventor: Thomas L. Steele, Jesup, Iowa

[73] Assignees: John S. Schmitz; Roger W. Theobald, both of Omaha, Nebr.

[21] Appl. No.: 116,137

[22] Filed: Jan. 28, 1980

[51] Int. Cl.[3] ..... B21D 22/14

[52] U.S. Cl. ..... 72/83; 72/70

[58] Field of Search ..... 72/83, 82, 70

[56] References Cited

U.S. PATENT DOCUMENTS

| | | | |
|---|---|---|---|
| 1,003,849 | 9/1911 | Worth | 72/83 |
| 1,262,780 | 4/1918 | Griffin | 72/83 |
| 2,983,033 | 5/1961 | Cox | 72/83 X |
| 3,205,688 | 9/1965 | Paulton | 72/83 |
| 3,316,745 | 5/1967 | Berghahn et al. | 72/83 |
| 3,391,439 | 7/1968 | Bulgrin et al. | 72/83 X |
| 3,434,321 | 3/1969 | Morgan | 72/83 |
| 3,946,585 | 3/1976 | Caboni et al. | 72/83 |
| 3,991,598 | 11/1976 | Kraft | 72/83 |

*Primary Examiner*—J. M. Meister

*Attorney, Agent, or Firm*—Henderson & Sturm

[57] ABSTRACT

This invention relates to an apparatus used to form various size chimney chases which utilizes a metal spinning machine in a manner to form and configure a sheet of metal into the desired configuration and dimensions.

1 Claim, 7 Drawing Figures

APPARATUS FOR FORMING A UNIVERSAL CHASE TOP

BACKGROUND OF THE INVENTION

Chase tops for the exhaust pipes of home fireplaces to prevent birds, squirrels, leaves, debris etc., have been around for quite a few years; however, the methods employed in the fabrication of such devices have been crude, antiquated, expensive and time consuming.

Most chase tops are either custom made in a sheet metal shop at great expense, or they are mass produced by bonding a separate collar to an apertured piece of sheet metal. In the first instance, the cost incurred is substantial due to the multiple stages in the fabrication, but balanced somewhat by the close tolerance fit which results. In the second instance, the end product is crude in appearance, usually has wide tolerances between the cooperating elements, but is relatively inexpensive since there are very few stages in the fabrication process.

There has been a long felt need by purchasers of chase tops for a well built, aesthetically pleasing chase top which can be produced inexpensively, in quantity, and in various sizes to accomodate exhaust pipes having a variety of circumferences. To date, there has not been a method or apparatus devised which can produce the desired end product. This fact has led to the development of the method and apparatus which forms the basis of this invention.

SUMMARY OF THE INVENTION

An object of the instant invention is the provision of a method and apparatus which can inexpensively produce chase tops.

A further object of the instant invention is the provision of a method and apparatus which can produce chase tops in quantity and in a variety of sizes.

Still another object of the instant invention is the utilization of a spinning lathe as an integral part of the apparatus which functions in accordance with the novel method employed in the fabrication of the chase tops.

Yet another object of the instant invention is the provision of a method and apparatus which will mass produce an end product which can be nested to facilitate transportation of the product in bulk.

A still further object of the instant invention is the provision of a method and apparatus which will produce an integral chase top which is both aesthetically pleasing and functional .

These and other objects, advantages and novel features of the invention will become apparent from the following detailed description of the invention when considered in conjunction with the accompanying drawings.

DESCRIPTION OF THE PREFERRED EMBODIMENT

Figure 1:
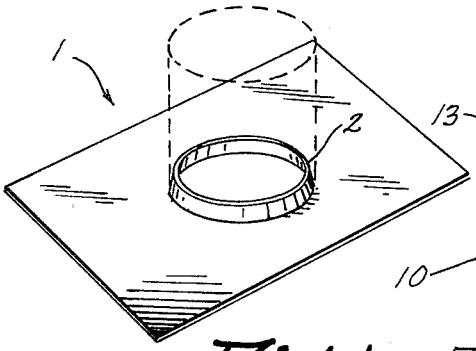
FIG. 1 is a perspective view of the end product produced by the method and apparatus which forms the basis of this invention.

As can be seen in FIG. 1, the method and apparatus which form the basis of this invention produce a chase top 1 having a tapered collar 2 which fits snugly around the circumference of a home fireplace exhaust pipe (shown in phantom).

Figure 2:
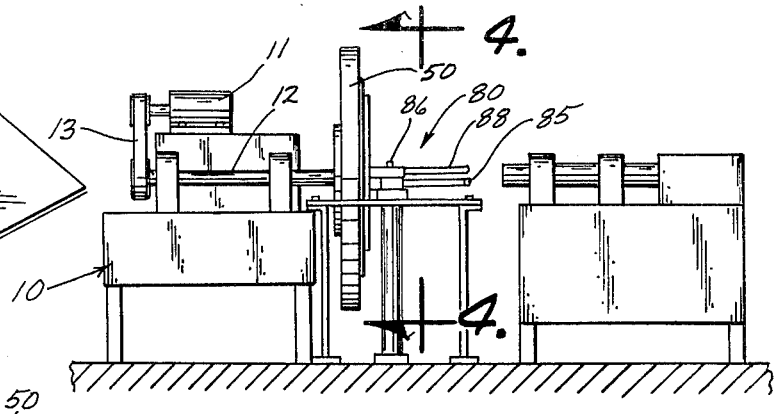
FIG. 2 is a side elevation view of the apparatus which performs the method used to produce the chase tops.

The apparatus which is used to perform this method is illustrated in FIG. 2 and has major components comprising a spinning lathe designated generally as 10, a chuck 50 and a compound tool 80. The spinning lathe 10 is powered by a motor 11 which drives a shaft 12 through a belt 13 in a well known manner. The output end of the shaft 12 is provided with a flat circular metal disc 14. The disc 14 is rigidly secured to the shaft 12 and has an outer ring of apertures 15 and an inner ring of apertures 16 radially disposed thereon.

The chuck 50 comprises a thick circular wooden disc 51 having a large centrally disposed circular opening 52 and a ring of apertures 15′ which coincide with apertures 15 on the disc 14. A plurality of securing means 54 extend through the complementary apertures 15 and 15′ to secure the chuck 50 to the disc 14 and position the opening 52 coaxially on the shaft 12. The face of the chuck 50 is further provided with a plurality of pivoted clamps 53 and brackets 55.

A tooling element 60 is dimensioned to be received within the central opening 52, and comprises a hollow metal cylinder 61 having a tapered core 62, and a plurality of apertures 16′ on its periphery which coincide with apertures 16 on the metal disc 14. The tooling element 60 is secured within the chuck 50 and to the disc 14 via a plurality of fastening means 56 which extend through the complementary apertures 16 and 16′.

The chase top 1 prior to deformation comprises a flat sheet 3 of galvanized steel, preferably 26 gauge and having a Rockwell Hardness of 51 to 55. Prior to insertion into the apparatus a Nibbler (not shown) is used to cut a circular hole 4 in the sheet 3. The edges of the hole 4 are then smoothed by filing to remove burrs, and the sheet is then placed on the chuck 50.

Figure 3:
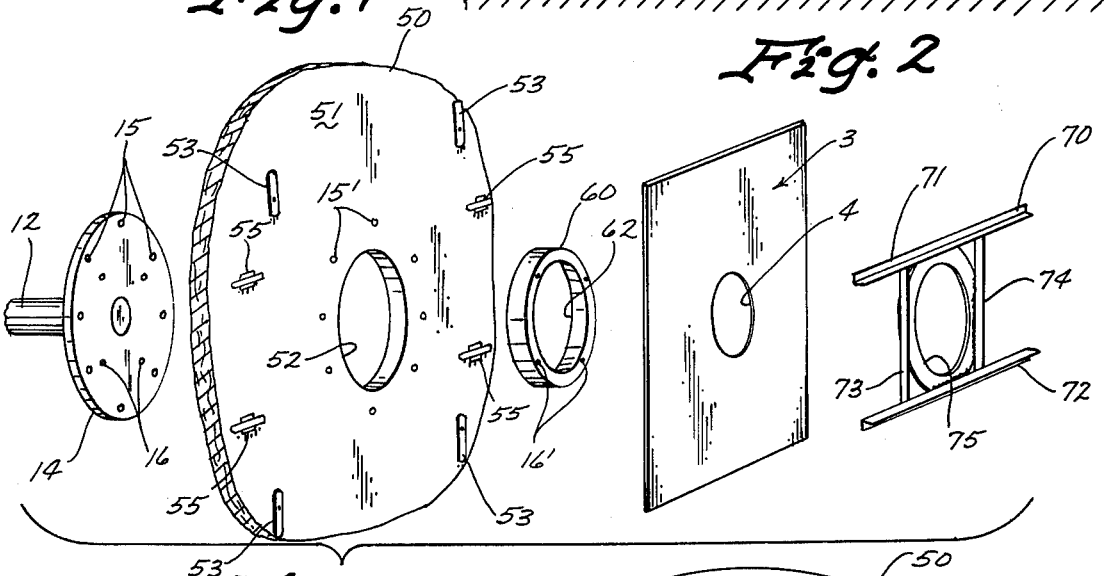
FIG. 3 is an exploded perspective view of the primary working components of the spinning chuck used in this invention.
Figure 4:
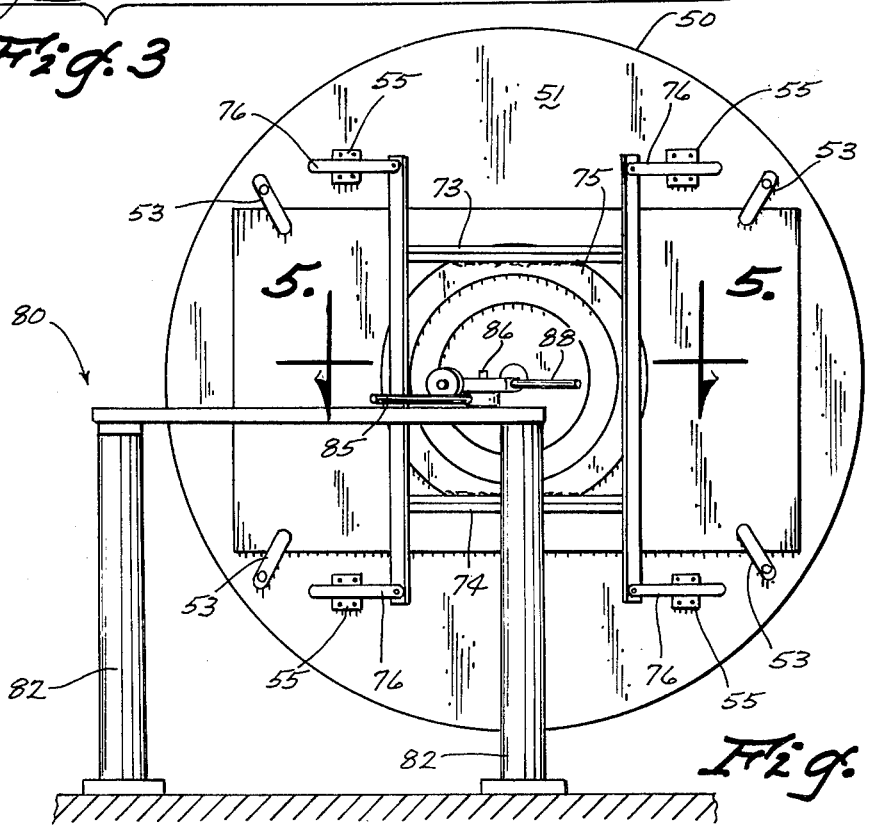
FIG. 4 is a view showing the chase top clamped to the spinning chuck and prior to deformation by the compound tool taken along line 4—4 of FIG. 2.

As can best be seen in FIGS. 3 and 4, the pivoted clamps 53 are then manipulated to support the sheet 3 on the chuck 50, and center the hole 4 over the tooling element 60. The sheet 3 is then further secured to the chuck 50 by the engagement of a reinforced bracket member 70 with the brackets 55 on the face of the chuck 50.

The bracket member 70 comprises a pair of flanged elongated legs 71 and 72, connected by intermediate members 73 and 74, all of which are welded or otherwise secured to a reinforcing plate 75. The reinforcing plate 75 comprises an apertured metal disc whose opening is dimensioned to coincide with the opening in the tooling element 60. The ends of the elongated legs 71 and 72 are further provided with pivoted extensions 76 which form the connections between the reinforced bracket 70 and the mounting brackets 55.

Once the sheet 3 is secured to the chuck 50, the compound tool 80 is brought into play. The compound tool 80 comprises a base member 81 supported by a plurality of upright supports 82. The base member 81 has a plurality of apertures 83 which are dimensioned to receive a pivot rod 84 which projects downwardly from pivot arm 85 of the tool 80. The pivot arm 85 is further provided with a second pivot rod 86 which projects upwardly therefrom, and through one of a plurality of apertures 87 disposed on pivoted arm 88. Pivoted arm 88 is further provided with a rotatably disposed deforming member 89.

Figure 5:
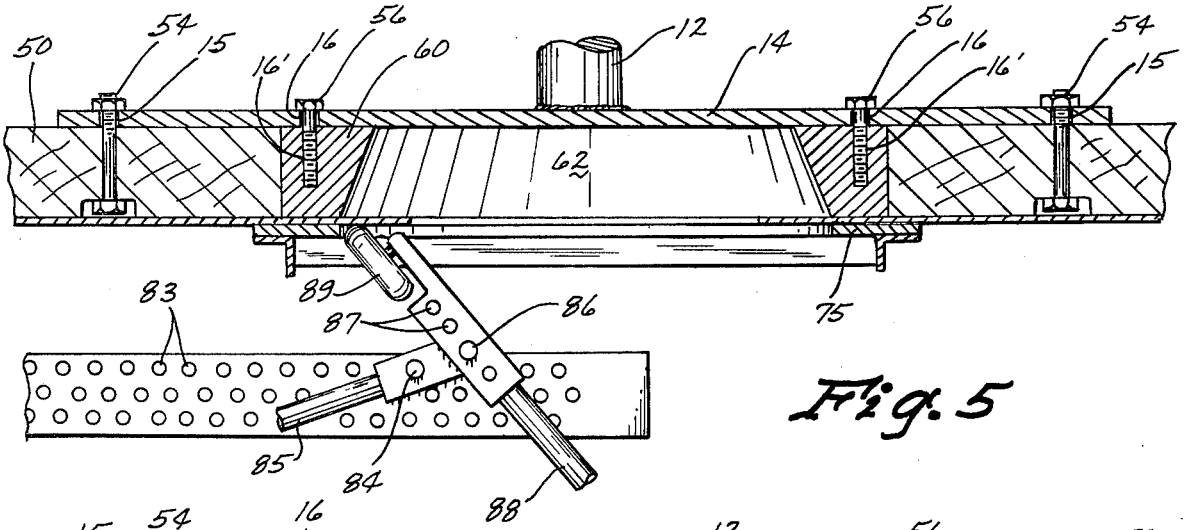
FIG. 5 is a top view of the unfinished chase top prior to deformation by the compound tool.
Figure 6:
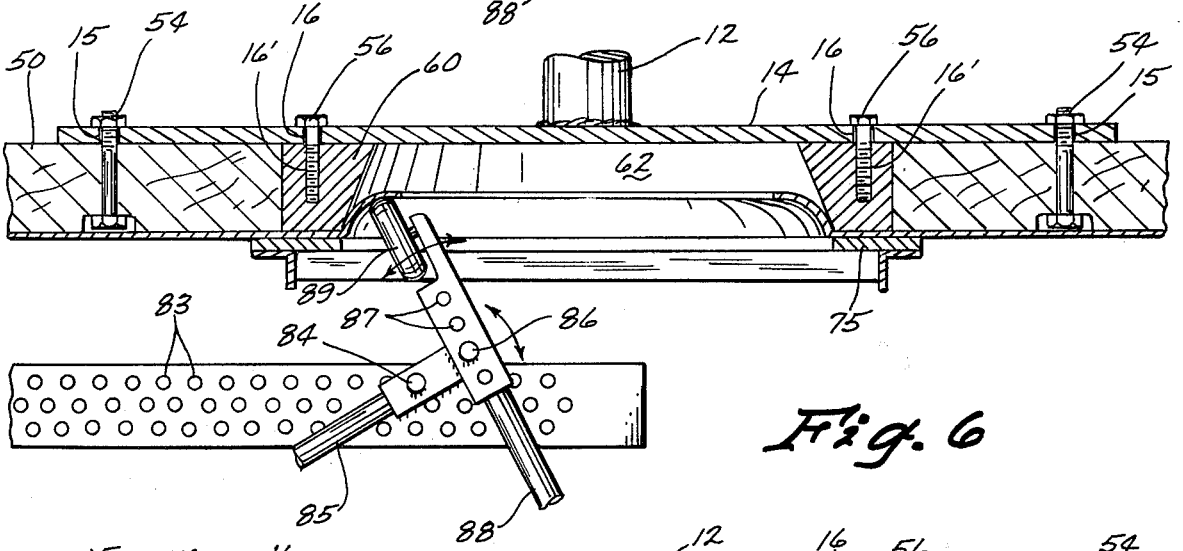
FIG. 6 is a top view of the unfinished chase top during deformation by the compound tool.
Figure 7:
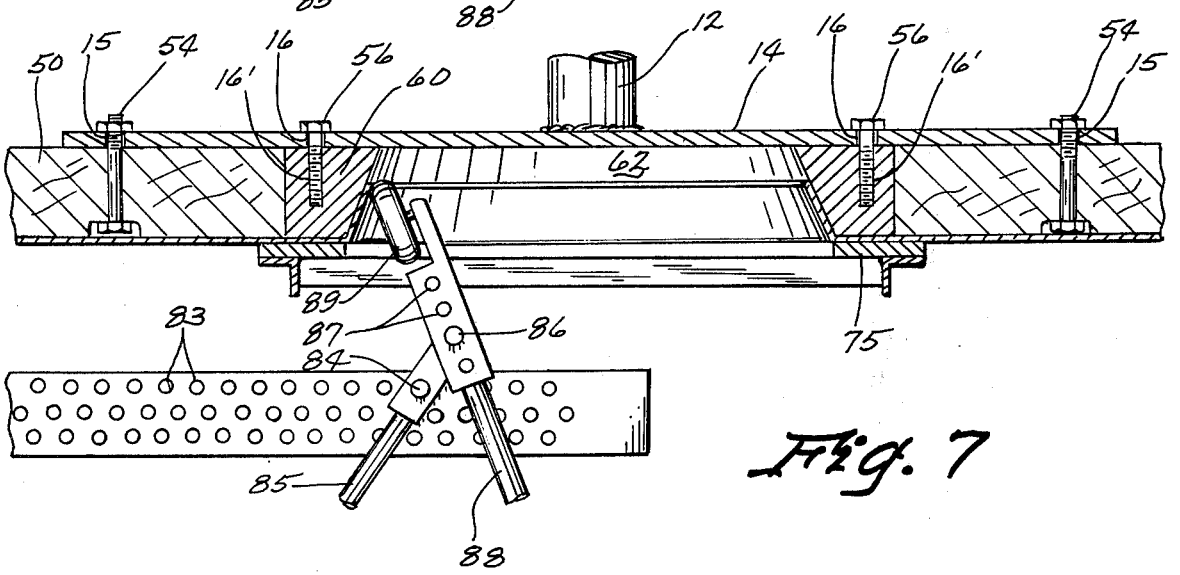
FIG. 7 is a top view of the unfinished chase top after deformation by the compound tool has been completed.

The deformation of the sheet 3 to form the chase top 1 is illustrated in FIGS. 5 through 7 and comprises the steps of: mounting the sheet on the chuck 50, securing the reinforcing bracket 70 over the sheet 3 and to the chuck 50, positioning the deforming member 89 adjacent to the surface of the sheet, starting the spinning lathe 10 to rotate the chuck 50 at a high rate of speed, pivoting the arms 85 and 88 of the compound tool 80 to force the deforming member 89 against the surface of the sheet, and continuing the application of force by the deforming member 89 against the sheet 3 until the sheet conforms to the sides of the tooling element 60.

It should be appreciated that chase tops having a variety of configurations and different sized openings can be fabricated by this apparatus, by substituting tooling elements 60 whose interior configuration will provide the desired profile, and by substituting reinforcing brackets 70 whose openings coincide with the tooling element opening.

It is necessary to have complementary openings in the tooling element 60 and reinforcing bracket 70 for several reasons. When the reinforcing bracket 70 is secured in place, the apertured reinforcing disc 75 holds the sheet 3 tightly against the chuck 50, and further provides a protective surface which will preclude contact of the deforming element with the surface of the sheet except in the areas which are intended to be deformed.

The chase top 1 which is formed by this method is an integral one piece sheet of galvanized steel having a tapered upstanding collar which will provide zero clearance around an exhaust pipe for a home fireplace. Not only are the chases formed by this method aesthetically pleasing and capable of being mass produced, but they also can be nested for transportation, and since there is a gradual transition zone from the flat portion of the sheet to the tapered collar, the chances of fatigue failure of the metal during fabrication are substantially reduced.

Having thereby disclosed the subject matter of this invention, it should be obvious that many modifications, substitutions and variations of the invention are possible in light of the above teachings. It is therefore to be understood, that the invention may be practiced other than as specifically described, and should be limited only by the breadth and scope of the appended claims.

I claim:

1. An apparatus used in the fabrication of a chase top for a fireplace exhaust pipe comprising:

a flat circular metal disc containing an outer ring of apertures and an inner ring of apertures, said disc being normal to and centered on a central axis;

a circular wooden chuck containing a centrally disposed circular opening and a ring of apertures therein which coincide with said outer ring of apertures on said metal disc, said chuck being normal to and centered on said central axis;

a plurality of securing means for fastening said chuck to said metal disc wherein said securing means being disposed through said outer ring of apertures on said metal disc and through said ring of apertures on said chuck;

a circular tooling element having an outside diameter corresponding to the diameter of said circular opening in said chuck and containing a tapered circular opening and a plurality of apertures which coincide with said inner ring of apertures on said metal disc, said tooling element being normal to and centered on said central axis;

a plurality of fastening means for fastening said tooling element to said metal disc wherein said fastening means are disposed through said inner ring apertures in said metal disc and into said plurality of apertures on said tooling element;

a plurality of clamps pivotally attached to said chuck and a plurality of mounting brackets rigidly attached to said chuck;

a reinforcing plate means for releasably securing an apertured flat sheet of metal to said chuck for cooperation with said plurality of mounting brackets, said reinforcing plate means being normal to and centered on said central axis;

means for rotating said metal disc about said central axis thereby rotating said chuck, said tooling element, said flat sheet of metal and said reinforcing plate means;

a base member containing a plurality of apertures;

a pivot arm;

a pivot rod rigidly connected to said pivot arm and projecting downwardly from said pivot arm, said pivot rod extending through one of the apertures on said base member;

a second pivot arm containing a plurality of apertures;

a second pivot rod rigidly connected to said first pivot arm and projecting upwardly from said first pivot arm, said second pivot rod extending through one of the apertures on said second pivot arm; and a movable deforming element rotatably disposed on said second pivot arm, said deforming element being a cylinder having a height less than the diameter and having both circumferential edges rounded, said deforming element being positioned adjacent to said circular opening in said tooling element and adapted to deform said flat sheet of metal whereby said flat sheet of metal is bent to conform to said tapered opening in said tooling element as said flat sheet of metal is rotated about said central axis.

* * * * *